US005148793A

United States Patent [19]

Reddy

[11] Patent Number: 5,148,793

[45] Date of Patent: Sep. 22, 1992

[54] COMPARTMENTAL EVAPORATIVE CANISTER AND PRESSURE CONTROL VALVE ASSEMBLY

[75] Inventor: S. Raghuma Reddy, West Bloomfield, Mich.

[73] Assignee: General Motors Corporation, Detroit, Mich.

[21] Appl. No.: 702,859

[22] Filed: May 20, 1991

[51] Int. Cl.[5] ..... F02M 33/02

[52] U.S. Cl. ..... 123/520; 123/198 D; 55/387

[58] Field of Search ..... 123/520, 521, 518, 516, 123/519, 198 D; 55/387, 316

[56] References Cited

U.S. PATENT DOCUMENTS

| | | | |
|---|---|---|---|
| 3,352,294 | 11/1967 | Piller . | |
| 3,515,107 | 6/1970 | Joyce . | |
| 3,575,152 | 4/1971 | Wentworth . | |
| 3,730,158 | 5/1973 | St. Amand . | |
| 3,884,204 | 5/1975 | Krautworst . | |
| 4,070,828 | 1/1978 | Barres | 123/521 |
| 4,153,025 | 5/1979 | Thornborgh . | |
| 4,203,401 | 5/1980 | Kinglsey . | |
| 4,279,233 | 7/1981 | Tobita . | |
| 4,306,874 | 12/1981 | Fukami . | |
| 4,308,840 | 1/1982 | Hiramatsu . | |
| 4,496,379 | 1/1985 | Kozawa . | |
| 4,790,283 | 12/1988 | Uranishi | 123/520 |
| 4,836,172 | 6/1989 | Haruta | 123/521 |
| 4,872,439 | 10/1989 | Sonada | 123/519 |
| 4,887,578 | 12/1989 | Woodcock | 123/520 |
| 4,894,072 | 1/1990 | Turner . | |
| 4,951,643 | 8/1990 | Sata . | |
| 5,056,494 | 10/1991 | Kayanuma | 123/519 |
| 5,088,466 | 2/1992 | Tada | 123/520 |

FOREIGN PATENT DOCUMENTS

| | | | |
|---|---|---|---|
| 0023348 | 2/1980 | Japan | 123/520 |
| 0029761 | 2/1984 | Japan | 123/520 |

*Primary Examiner*—Carl S. Miller
*Attorney, Agent, or Firm*—Charles K. Veenstra

[57] ABSTRACT

A fuel vapor storage canister to prevent breakthrough evaporative emission loss and facilitate purging by concentrating the fuel vapor close to the vent to the engine. The canister is divided into two compartments which communicate through a connective means that only allows vapor into the second compartment when a control valve, located in the connective means, opens at a threshold pressure.

9 Claims, 1 Drawing Sheet

COMPARTMENTAL EVAPORATIVE CANISTER AND PRESSURE CONTROL VALVE ASSEMBLY

TECHNICAL FIELD

This invention relates to vehicle fuel system evaporation loss control in general, and specifically to a fuel vapor storage canister that has increased efficiency for vapor adsorption and vapor purge.

BACKGROUND OF THE INVENTION

Evaporative fuel vapors generated in a vehicle fuel system are adsorbed by activated carbon (charcoal) in a canister and later purged and consumed during engine combustion. During a typical period when the vehicle is parked with the engine off, called a soak, the canister becomes only partially loaded with hydrocarbon vapor, or partially saturated with hydrocarbon vapor from the fuel tank. The partially saturated canister may experience several hours of soak before it is purged or reloaded with vapors. Partially loaded or purged canisters left overnight have shown far less available vapor adsorption capacity and a higher tendency to have hydrocarbon vapor filter out of the canister through the atmospheric vent to yield breakthrough emissions, than similar canisters tested immediately.

SUMMARY OF THE INVENTION

Recent studies have determined that the concentrated mass of vapors initially collects at the top of the canister, but with time is dispersed throughout the canister. After soaking, a canister will purge more slowly because the vapor is no longer concentrated in a small area.

The present invention is a compartmental evaporative canister and pressure control valve assembly. The pressure control valve isolates an auxiliary compartment of the canister from a main compartment. The main compartment contains one or more chambers which communicate with each other by restrictive passages. The top chamber of the main compartment is intended for storing daily vapor generation. The purpose of the auxiliary compartment is to reduce breakthrough emissions by preserving a portion of clean carbon. Since some vapor migration can occur through the compartment openings, the auxiliary compartment is isolated from the final chamber of the main compartment by using a pressure control valve.

Installing a pressure control valve to isolate the bottom compartment further reduces breakthrough emissions and preserves the working capacity of a partially saturated canister. A pressure control valve similar to that disclosed in U.S. Pat. No. 4,153,025 issued May 8, 1979 to William F. Thornburgh is currently used on some vehicles to reduce tank vapor generation. By installing the pressure control valve on the canister before the last compartment it can reduce both tank vapor generation and canister breakthrough emissions.

Previous uses of compartmental canisters were to disperse evenly the fuel vapors to the lower chambers in order to utilize fully the whole canister or to separate the vapors from the fuel tank from those from the carburetor bowl as in U.S. Pat. No. 4,203,401 issued May 20, 1980 to Charles A. Kingsley et al; U.S. Pat. No. 4,308,840 issued Jan. 5, 1982 to Eizi Hiramatsu et al, and U.S. Pat. No. 4,496,379 issued Jan. 29, 1985 To Tadashi Kozawa. Although current evaporative systems incorporate a pressure control valve, it is used to separate the fuel vapors into individual canisters, to regulate fuel vapors from the tank to the canister, and to regulate the vapor back to the carburetor.

The adverse effects of vapor migration and redistribution will become much more significant in larger canisters which may be used to store multiple diurnal emissions. Diurnal emissions are the loss of vapors from the tank resulting from the daily cyclic variations in tank temperature while the vehicle is at rest. Even though a large canister is employed for controlling multiple diurnal emissions and/or refueling emissions, only a small portion of the large canister will be utilized most of the time. Therefore, vapor migration and redistribution during soak can make it harder to purge the canister and may increase breakthrough emissions. Accordingly, the present invention has four objects. 1) It reduces vapor migration throughout the canister. 2) It improves the purge rate. 3) It improves vapor adsorption on subsequent soaks. And 4) it significantly reduces the chance of breakthrough emissions.

The details of this invention are set forth in the remainder of the specification and are shown in the drawing.

DETAILED DESCRIPTION

Figure 1:
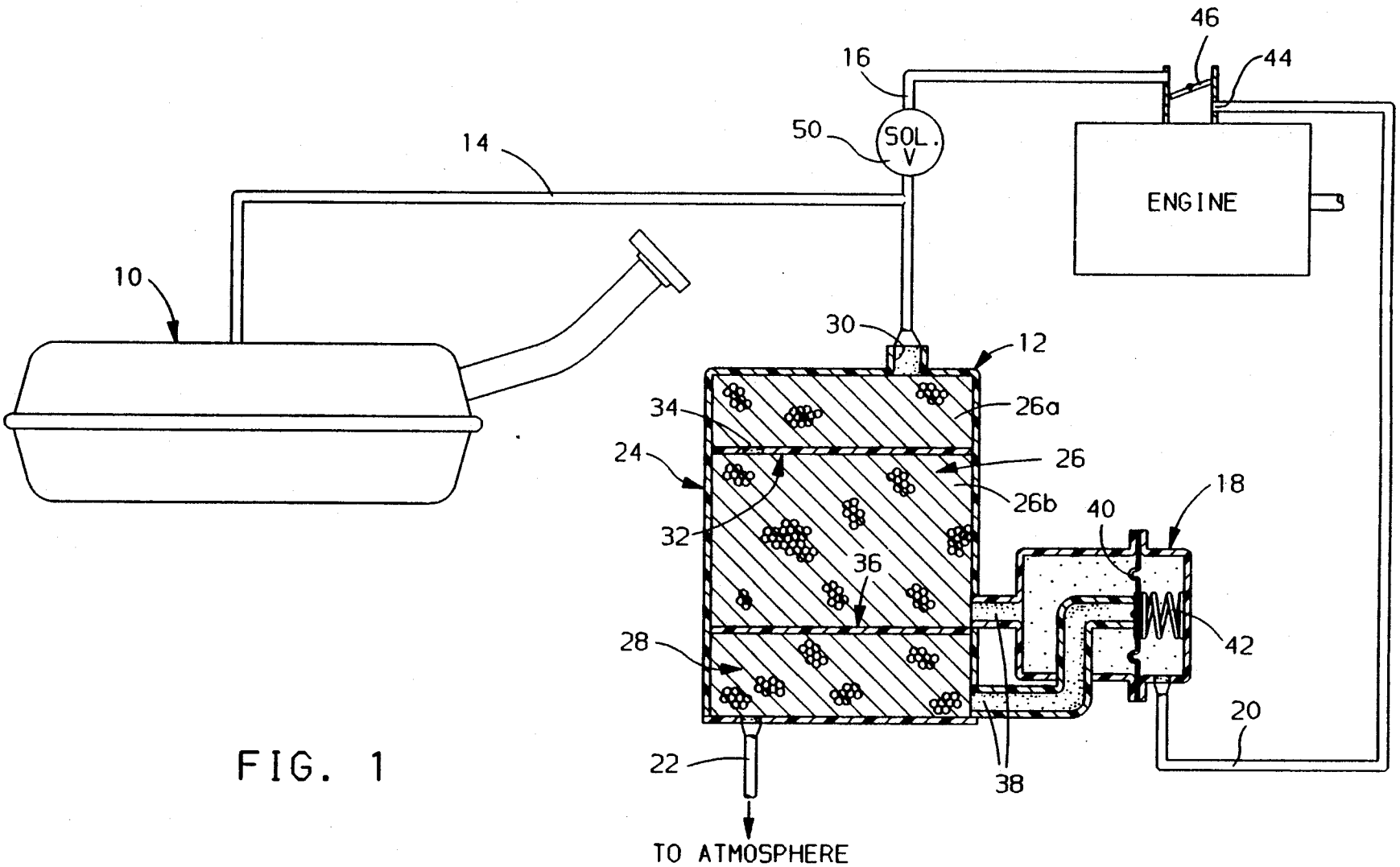
FIG. 1 is a schematic view of a fuel vapor recovery system having a compartmental emission canister and a control valve between the two compartments of the canister, in accordance with the invention.

In FIG. 1 the preferred embodiment of the system comprises a fuel tank 10, and a canister 12, connected to the air induction system of the vehicle engine by conduits 14, 16, and 20. When the pressure of the air-fuel vapor mixture formed in tank 10 exceeds the threshold pressure of the pressure control valve 18 the mixture is vented to canister 12 through conduit 14, where the fuel vapor component is stored in a manner more fully described below. When the vehicle is operating, engine vacuum from the air induction system opens the control valve 18, allowing air flow through canister 12 to desorb the stored fuel vapors and send them back to the engine intake.

The canister 12 has a molded plastic exterior housing 24, which encloses an interior volume, charged with activated charcoal granules, or the like, which are capable of adsorbing the fuel portion of the air-fuel vapor mixture that is fed through canister 12. The interior volume is partitioned horizontally into a main compartment 26 and an auxiliary compartment 28. The main compartment 26 is substantially larger than the auxiliary compartment 28 and has at least two chambers **26*a* and 26*b*. Fuel vapor vented through the vent line 14 enters the canister 12 through the inlet/outlet aperture 30 and into the first chamber 26*a*. A partition 32 divides the two chambers of the main compartment and has a passage 34 that allows vapor to pass between the two chambers. The passage 34 restricts the migration of the fuel vapor to the last chamber 26*b* of the main compartment 26, thereby providing a more efficient desorption of the canister 12 during purge by keeping the fuel vapor concentrated near the inlet/outlet aperture 30 in the first chamber 26*a***.

A partition 36 separates the last chamber **26*b* of the main compartment 26 and the auxiliary compartment 28. A connective means 38 joins the last chamber 26*b*** and the auxiliary compartment 28. A control valve 18 in the connective means 38 opens when the pressure in the main compartment 26 reaches a threshold level during the soaking period. The diaphragm 40 in the control valve 18 is biased by spring 42 to close the connective means 38 between the main compartment 26 and auxiliary compartment 28, and thereby obstruct vapor migration between the two compartments. During the soak, the pressure in the fuel tank 10 and main compartment 26 will reach a threshold to cause the diaphragm 40 to compress spring 42 and allow flow from the main compartment 26 to the auxiliary compartment 28. The diaphragm 40 will close the connective passage 38 once the pressure has been relieved. Because vapor cannot migrate from main compartment 26 to auxiliary compartment 28 when diaphragm 40 closes connective means 38, the auxiliary compartment 28 remains substantially clean of fuel vapor, and therefore essentially eliminates breakthrough emissions through the atmospheric vent 22, which is located at the bottom of chamber 28 through the exterior housing 24.

The control valve 18 also responds to vacuum from the manifold at port 44. During engine operation when the port 44 is subjected to the vacuum conditions below the throttle blade 46, the pressure differential across the diaphragm 40 will be sufficient to overcome the bias of the spring 42 and open. At the same time, vacuum applied to aperture 30 induces air flow through the atmospheric vent 22. The air will flow successively through the auxiliary compartment 28, the control valve 18 in the connective means 38, the chambers **26*b*, 26*a* of the main compartment 26, and out through the vapor inlet/-outlet aperture 30 in the first chamber 26*a*. The purge solenoid 50, normally closed when the engine is not running, opens to return the vapor to the intake of the engine by means of conduit 16. The purge solenoid 50** does not form part of the invention as such, but would generally be present.

The embodiments of the invention in which an exclusive property or privilege is claimed are defined as follows:

1. A fuel vapor storage canister assembly for an engine fuel system, comprising:

a main vapor storage compartment, an auxiliary vapor storage compartment, a vapor inlet/outlet aperture to the main compartment, and adapted for connection to a fuel tank and a source of engine vacuum, an atmospheric vent opening to the auxiliary compartment, a connective means between the main compartment and the auxiliary compartment, and a control valve, comprising a diaphragm and spring, in the connective means between said main compartment and the auxiliary compartment, and wherein said control valve is biased to prevent vapors from flowing from the main compartment into said auxiliary compartment, and is responsive to pressure in the main compartment to permit the diaphragm to unseat from against the connective means and allow the connective means to be open when the pressure in the main compartment reaches a selected level, whereby substantially all vapor is collected in the main compartment.

2. A fuel vapor storage canister assembly for an engine fuel system, comprising:

a generally elongated, adsorbent filled housing having a main compartment and an auxiliary compartment, a vapor inlet/outlet aperture to the main compartment, and adapted for connection to a fuel tank and a source of engine vacuum, an atmospheric vent opening to said auxiliary compartment, a connective means between the main compartment and the auxiliary compartment, and a control valve, comprising a diaphragm and spring, in the connective means between said main compartment and the auxiliary compartment, and wherein said control valve is biased to prevent vapors from flowing from the main compartment into said auxiliary compartment, and is responsive to pressure in the main compartment to permit the diaphragm to unseat from against the connective means and allow the connective means to be open when the pressure in the main compartment reaches a selected level, whereby substantially all vapor is collected in the main compartment.

3. A fuel vapor storage canister assembly for an engine fuel system, comprising:

a generally elongated, adsorbent filled housing having a volume partitioned either vertically or horizontally into a plurality of separate chambers that communicate with each other in succession to compose a main compartment, an adsorbent filled auxiliary compartment within the housing where the auxiliary volume is smaller than the main volume, a vapor inlet/outlet aperture to the first chamber of the main compartment, and adapted for connection to a fuel tank and a source of engine vacuum, an atmospheric vent opening to auxiliary compartment, a connective means between the last chamber of the main compartment and the auxiliary compartment, and a control valve, comprising a diaphragm and spring, in the connective means between said main compartment and the auxiliary compartment, and wherein said control valve is biased to prevent vapors from flowing from the main compartment into said auxiliary compartment, and is responsive to pressure in the main compartment to permit the diaphragm to unseat from against the connective means and allow the connective means to be open when the pressure in the main compartment reaches a selected level, whereby substantially all vapor is collected in the main compartment.

4. A fuel vapor storage canister assembly for an engine fuel system, comprising:

a main adsorbent filled compartment comprising of multiple separate chambers that communicate with each other in succession to compose the main compartment, an adsorbent filled auxiliary compartment where the auxiliary volume is smaller than the main volume, a vapor inlet/outlet aperture to the first chamber of the main compartment, an atmospheric vent opening to auxiliary compartment, a connective means between the last chamber of the main compartment and the auxiliary compartment, and a control valve, comprising a diaphragm, and spring, in the connective means between said main compartment and auxiliary compartment, and wherein said control valve is biased to prevent vapors from flowing from the main compartment into said auxiliary compartment, and is responsive to pressure in the main compartment to permit the diaphragm to unseat from against the connective means and allow the connective means to be open when the pressure in the main compartment reaches a selected level, whereby substantially all vapor is collected in the main compartment.

5. A fuel vapor storage canister assembly for an engine fuel system, comprising:

a main vapor storage compartment, an auxiliary vapor storage compartment, a vapor inlet/outlet aperture to the main compartment, and adapted for connection to a fuel tank and a source of engine vacuum, an atmospheric vent opening to the auxiliary compartment, a connective means between the main compartment and the auxiliary compartment, a control valve, comprising a diaphragm, spring, and vacuum orifice, in the connective means between said main compartment and the auxiliary compartment, and a vacuum line connectable to the induction system of the engine and joining the control valve at the vacuum orifice, and wherein said control valve is biased to prevent vapors from flowing from the main compartment into said auxiliary compartment, thereby keeping the auxiliary compartment's adsorbent material clean from hydrocarbon vapors by concentrating said vapors closer to the inlet/outlet aperture, and thereby improving purging capabilities during which engine vacuum acts upon the spring in the control valve to unseat the diaphragm which opens the control valve and draws in air through the atmospheric vent which successively flows into the auxiliary compartment, through the control valve, and into the main compartment to retrieve the hydrocarbon vapors and return them to the engine.

6. A fuel vapor storage canister assembly for an engine fuel system, comprising:

a generally elongated, adsorbent filled housing having a main compartment and an auxiliary compartment, a vapor inlet/outlet aperture to the main compartment, and adapted for connection to a fuel tank and a source of engine vacuum, an atomspheric vent opening to said auxiliary compartment, a connective means between the main compartment and the auxiliary compartment, a control valve, comprising a diaphragm, spring, and a vacuum orifice, in the connective means between said main compartment and auxiliary compartment, and a vacuum line connectable to the induction system of the engine and joining the control valve at the vacuum orifice, and wherein said control valve is biased to prevent vapors from flowing from the main compartment into said auxiliary compartment, thereby keeping the auxiliary compartment's adsorbent material clean from hydrocarbon vapors by concentrating said vapors closer to the inlet/outlet aperture, and thereby improving purging capabilities during which engine vacuum acts upon the spring in the control valve to unseat the diaphragm which opens the control valve and draws in air through the atmospheric vent which successively flows into the auxiliary compartment, through the control valve, and into the main compartment to retrieve the hydrocarbon vapors and return them to the engine.

7. A fuel vapor storage canister assembly for an engine fuel system, comprising:

a generally elongated, adsorbent filled housing having a total volume partitioned either vertically or horizontally into a plurality of separate chambers that communicate with each other in succession to compose a main compartment, an adsorbent filled auxiliary compartment within the housing where the auxiliary volume is smaller than the main volume, a vapor inlet/outlet aperture to the first chamber of the main compartment, and adapted for connection to a fuel tank and a source of engine vacuum, an atmospheric vent opening to auxiliary compartment, a connective means between the last chamber of the main compartment and the auxiliary compartment, a control valve, comprising a diaphragm, spring, and vacuum orifice, in the connective means between said main compartment and auxiliary compartment, and a vacuum line connectable to the induction system of the engine and joining the control valve at the vacuum orifice, and wherein said control valve is biased to prevent vapors from flowing from the main compartment into said auxiliary compartment, thereby keeping the auxiliary compartment's adsorbent material clean from hydrocarbon vapors by concentrating said vapors closer to the inlet/outlet aperture, and thereby improving purging capabilities during which engine vacuum acts upon the spring in the control valve to unseat the diaphragm which opens the control valve and draws in air through the atmospheric vent which successively flows into the auxiliary compartment, through the control valve, and into the main compartment to retrieve the hydrocarbon vapors and return them to the engine.

8. A fuel vapor storage assembly for an engine fuel system, comprising:

a main adsorbent filled compartment having a volume partitioned either vertically or horizontally into a plurality of separate chambers that communicate with each other in succession to compose a main compartment, an adsorbent filled auxiliary compartment where the auxiliary volume is smaller than the main volume, a vapor inlet/outlet aperture to the first chamber of the main compartment, and adapted for connection to a fuel tank and a source of engine vacuum, an atmospheric vent opening to auxiliary compartment, a connective means between the last chamber of the main compartment and the auxiliary compartment, a control valve, comprising a diaphragm, spring, and vacuum orifice, in the connective means between said main compartment and auxiliary compartment, and a vacuum line connectable to the induction system of the engine and joining the control valve at the vacuum orifice, and wherein said control valve is biased to prevent vapors from flowing from the main compartment into said auxiliary compartment, thereby keeping the auxiliary compartment's adsorbent material clean from hydrocarbon vapors by concentrating said vapors closer to the inlet/outlet aperture, and thereby improving purging capabilities during which engine vacuum acts upon the spring in the control valve to unseat the diaphragm which opens the control valve and draws in air through the atmospheric vent which successively flows into the auxiliary compartment, through the control valve, and into the main compartment to retrieve the hydrocarbon vapors and return them to the engine.

9. A fuel vapor storage canister assembly for an engine fuel system, comprising:

a generally elongated, adsorbent filled housing having a volume partitioned either vertically or horizontally into a plurality of separate chambers that communicate with each other in succession to compose a main compartment, an adsorbent filled auxiliary compartment within the housing where the auxiliary volume is smaller than the main volume, a vapor inlet/outlet aperture to the first chamber of the main compartment, and adapted for connection to a fuel tank and a source of engine vacuum, an atmospheric vent opening to the auxiliary compartment, a connective means between the last chamber of the main compartment and the auxiliary compartment, a control valve, comprising a diaphragm, spring, and vacuum orifice, in the connective means between said main compartment and auxiliary compartment, and a vacuum line connectable to the induction system of the engine and joining the control valve at the vacuum orifice, and wherein said control valve is biased to prevent vapors from flowing from the main compartment into said auxiliary compartment, and is responsive to pressure in the main compartment to permit the diaphragm to unseat from against the connective means and allow the connective means to be open when the pressure in the main compartment reaches a selected level, thereby keeping the auxiliary compartment's adsorbent material clean from hydrocarbon vapors by concentrating said vapors closer to the inlet/outlet aperture, and thereby improving purging capabilities during which engine vacuum acts upon the spring in the control valve to unseat the diaphragm which opens the control valve and draws in air through the atmospheric vent which successively flows into the auxiliary compartment, through the control valve, and into the main compartment to retrieve the hydrocarbon vapors and return them to the engine.

* * * * *